United States Patent [19]

Benninghoven

[11] Patent Number: 4,465,459

[45] Date of Patent: Aug. 14, 1984

[54] COAL DUST BURNER

[76] Inventor: Erich Benninghoven, No. 66, Spreestrasse, 5650 Solingen 11, Fed. Rep. of Germany

[21] Appl. No.: 336,974

[22] Filed: Jan. 4, 1982

[30] Foreign Application Priority Data

Jul. 17, 1981 [DE] Fed. Rep. of Germany ..... 3128334

[51] Int. Cl.[3] ..... F23Q 9/00

[52] U.S. Cl. ..... 431/284; 431/186; 431/189; 431/285; 110/262; 239/456; 239/513

[58] Field of Search ..... 431/278, 284, 285, 186, 431/189; 110/260–266; 239/424.5, 430, 456, 458, 513

[56] References Cited

U.S. PATENT DOCUMENTS

| | | | |
|---|---|---|---|
| 4,098,255 | 7/1978 | Nowak et al. | 431/284 X |
| 4,243,375 | 1/1981 | Reed | 431/284 X |
| 4,347,052 | 8/1982 | Reed et al. | 431/284 X |
| 4,389,188 | 6/1983 | Kamath | 239/424.5 X |

FOREIGN PATENT DOCUMENTS

| | | | |
|---|---|---|---|
| 1279882 | 10/1968 | Fed. Rep. of Germany | 110/261 |
| 2809114 | 9/1979 | Fed. Rep. of Germany | 431/284 |
| 532898 | 2/1922 | France | 110/262 |
| 28028 | 3/1977 | Japan | 431/284 |
| 863751 | 3/1961 | United Kingdom | 239/456 |

*Primary Examiner*—Samuel Scott
*Assistant Examiner*—Kenichi Okuno
*Attorney, Agent, or Firm*—John C. Smith, Jr.

[57] ABSTRACT

A burner is disclosed for alternatively burning coal dust or oil. An annular housing includes a blower at one end thereof for directing a rotating air stream through the housing. A chamber located downstream from the blower has a plurality of outlet pipes extending downstream therefrom in an annular configuration about an atomizing nozzle and an eddy plate. An adjustable burner head is mounted on the end of each of the outlet pipes, the burner heads being arranged for optimum mixture of coal dust and air, fed from the chamber through the outlet pipes to the burner heads, with the rotating air stream passing about and through a hole in the eddy plate to insure optimum combustion. An oil ignition auxiliary burner having a nozzle between the eddy plate and the outlet end of the chamber serves to ignite the coal dust and air mixture. An atomizing nozzle for feeding atomized oil into the burner is provided as an alternative fuel source.

3 Claims, 4 Drawing Figures

COAL DUST BURNER

BACKGROUND OF THE INVENTION

This invention is related to a coal dust burner having a housing in which a mixture of coal dust and air is subdivided into an ample number of separate currents which mix with secondary air flowing through the housing of the coal dust burner.

The known coal dust burners suffer from an essential drawback, which is as follows: In order to ensure faultless combustion the conveyor pipe supplying the mixture of coal dust and air is provided on its downstream side with a deflecting body by which the mixture of coal dust and air is subdivided into a large number of separate currents. These separate currents, however, are so closely concentrated that the optimum mixing of the coal dust and air mixture with the secondary air cannot be obtained. Furthermore, the known types of coal dust burners cannot be used in oil-fuelled systems. Their useability with oil is nevertheless a definite need, as it is by no means out of the question that a failure may occur in the feed of the coal dust and air mixture or that the coal dust has not been delivered and is thus unavailable. In such circumstances, therefore, it has hitherto proved necessary to replace the coal dust burner by an oil burner, which is a complicated and time-consuming operation.

SUMMARY OF THE INVENTION

It is, therefore, the object of the present invention to enable a coal dust burner of the type described at the beginning to be improved as regards the mixing of the coal dust and air mixture with the secondary air and also to be further developed in a manner enabling it to be operated with oil likewise where need arises.

To attain this object the present invention provides a coal dust burner with a housing having a side wall and open ends in which a mixture of coal dust and air is subdivided into an ample number of separate currents which mix with secondary air flowing through the housing of the coal dust burner, comprising means providing a chamber situated in the housing of the coal dust burner but at a certain distance on all sides from the side wall of the housing; a pipe socket passing transversely through the side wall of the housing for feeding a mixture of coal dust and air into the chamber; a plurality of outlet pipes each having at one end a burner head and connected at the other end to the chamber, said outlet pipes being arranged in a circle and at a distance from one another; an eddy plate for the flame bedding having a central hole around which the outlet pipes are arranged, and an oil feed pipe having an atomizing nozzle on the upstream side of the hole of the eddy plate and terminating between the chamber and the eddy plate, said eddy plate being arranged to be operative in the case of feeding coal dust as well as in the case of feeding oil.

The burner according to the invention consists of a coal dust burner combined with an oil burner, with an eddy plate common to the two systems, the burner enabling the same performance to be obtained, no matter whether it is operated with coal dust or with oil, as in the case of a burner designed solely for operation with coal dust or for operation with oil. Furthermore, as a result of the fact that the mixture of coal dust and air emerges from a number of outlet pipes situated at a certain distance apart, the mixture of coal dust and air is mixed in the optimum manner with rotating secondary air flow, as well as with rotating air flow passing through the eddy plate, so that optimum combustion is ensured. A rotary blower at the suction end of the housing generates the rotating air flow in the housing. A slight net surplus of rotating air flow is used for cooling the jacket of the burner head common to the two systems, as a result of which the burner head jacket cannot burn and no protective fire-clay sleeve is required.

In an advantageous further development of the burner according to the invention the burner heads of the outlet pipes are situated on these latter in a rotatably and axially displaceable manner, as a result of which the outlet cross section and the direction of emergence are adjustable.

BRIEF DESCRIPTION OF THE DRAWING

An embodiment of the invention will now be described by way of example and with reference to the accompanying drawing in which.

DESCRIPTION OF THE PREFERRED EMBODIMENT

Figure 1:
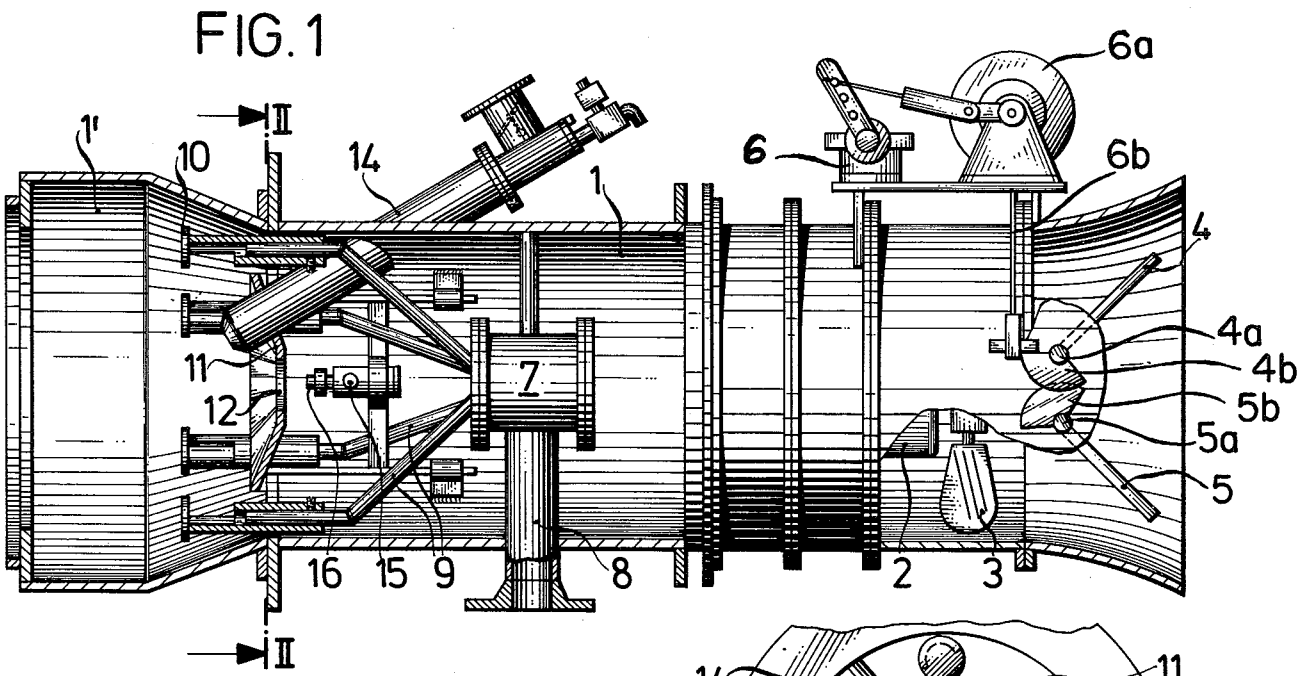
FIG. 1 is an elevational view, partly in section and cut away, of a coal dust burner according to the invention.

FIG. 1 shows a coal dust burner having a housing 1 and a jacket 1' for a burner head. In the housing 1 a blower consisting of a driving motor 2 and fan blades 3 is mounted on the suction side. On the suction side are also two air flaps 4 and 5, adjustable by means of a servo-motor 6 via a crank arrangement *6a*. The air flaps are pivotally mounted at *4a* and *5a* respectively and have toothed segments *4b* and *5b* respectively which mesh. A connecting rod *6b* extending from the crank arrangement *6a* to the toothed segment *4b* rotates the air flaps.

Figure 2:
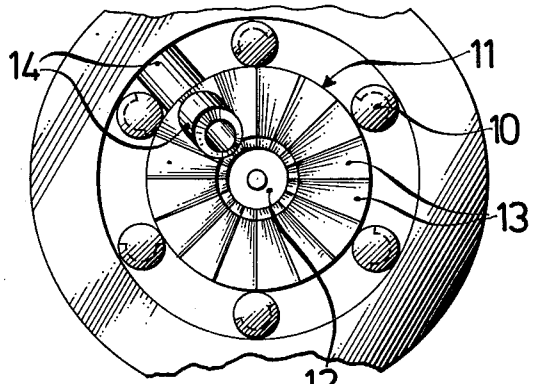
FIG. 2 is a section along the line II—II of FIG. 1.
Figure 4:
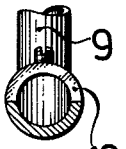
FIG. 4 is a section along the line IV—IV of FIG. 3.
Figure 3:
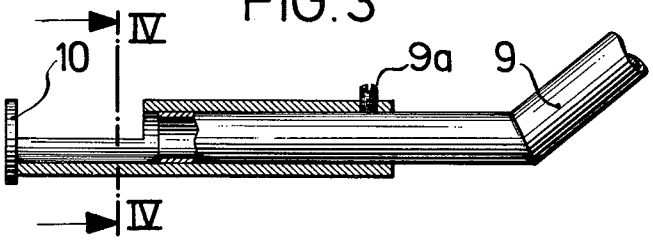
FIG. 3 is an elevational view, partly in section, of an outlet pipe and its burner head.

The housing 1 contains a chamber 7, which is mounted in a fixed position, at a certain distance in all directions from the side wall of the housing 1 to which is affixed a first duct or pipe socket 8 passing transversely through the side wall of the housing 1. The pipe socket 8 serves as a connecting means for a conveyor pipe, not shown in the drawing, for the mixture of coal dust and air. A plurality of angular outlet pipes 9, at a certain distance apart, are arranged in a circle on the chamber 7, burner heads 10 being mounted on the said outlet pipes 9 in such a way that each is rotatably displaceable and displaceable in the longitudinal direction to adjust the burner heads for maximum breakup of coal dust in the air flow. The outlet cross-section of the nozzle and the direction of emergence of the coal dust are adjustable, each burner head being secured in place by set screw *9a*. The outlet pipes 9 are arranged around a circular eddy plate 11 which is provided with a central hole 12. The eddy plate 11 consists, in a known manner, of individual laminar sectors 13 (FIG. 2). An oil ignition auxiliary burner 14 is inserted into the housing 1 from the side and passes through the eddy plate 11.

The coal dust and air mixture emerging from the burner heads 10 of the outlet pipes 9 is mixed with the rotating secondary air flowing through the housing 1 and with the rotating air emerging from the eddy plate 11, in which process the said mixture of coal dust and air is ignited by the oil ignition auxiliary burner 14 and the eddy plate 11 constitutes the flame bed.

A second duct or oil feed pipe 15 is introduced into the housing 1 of the coal dust burner from the side and terminates in the space betwen the chamber 7 and the eddy plate 11. The oil feed pipe 15 is provided with an atomizing nozzle 16 which is located on the upstream side of the central hole 12 of the eddy plate 11.

The oil emerging from the atomizing nozzle 16 passes through the central hole 12 of the eddy plate 11. The combustion process is thereby the same as when the burner is operated with coal dust.

The process of switching the burner over to oil operation is preferably carried out automatically, e.g. by electrical control.

The invention may be embodied in other specific forms without departing from the spirit or essential characteristics thereof. The embodiment is therefore to be considered in all respects as illustrative and not restrictive.

What is claimed is:

1. A burner for burning coal dust and oil and comprising:

(a) elongated annular wall means defining a housing, said wall means having open suction and outlet ends at opposite upstream and downstream ends thereof respectively;

(b) blower means at said suction end of said annular wall means for directing a rotating air stream through said housing;

(c) valve means in said housing adjacent said blower means for controlling the velocity of said air stream through said housing and means for regulating said valve means;

(d) means defining a chamber in said housing between said blower means and said outlet end of said wall means, said chamber being spaced inwardly from said wall means:

(e) first duct means connected to said chamber for feeding a mixture of coal dust and air into said chamber;

(f) an atomizing nozzle in said housing between said chamber and said outlet end of said wall means, said atomizing nozzle being spaced inwardly from said wall means and directed toward said outlet end of said wall means;

(g) second duct means connected to said atomizing nozzle for feeding oil to said nozzle;

(h) an edddy plate in said housing between said atomizing nozzle and said outlet end of said wall means and spaced from said wall means, said eddy plate having a central hole aligned with said atomizing nozzle such that atomized oil from said atomizing nozzle may be directed downstream through said central hole in said eddy plate;

(i) a plurality of outlet pipes arranged in an annular configuration and extending in a generally downstream direction from said chamber about said atomizing nozzle and eddy plate towards said outlet end of said wall means;

(j) a burner head mounted on the end of each of said outlet pipes, said burner heads being arranged in an annular configuration disposed downstream of said eddy plate, each said burner head being rotatably and longitudinally adjustable on the end of the respective outlet pipe such that said mixture of coal dust and air from said chamber may be directed transverse to the direction of said air stream and at least in part across the downstream side of said eddy plate for the optimum mixture of said coal dust and air from said burner heads with said rotating air stream passing about and through the hole in said eddy plate to insure optimum combustion, said eddy plate serving as a flame bedding; and (k) an oil ignition auxiliary burner having a nozzle between said eddy plate and said outlet end of said wall means;

(l) whereby coal dust and oil may be burned alternatively in said burner.

2. A burner as claimed in claim 1 wherein said valve means comprises adjustable air flaps at said suction end of said annular wall means for controlling the rate of air flow through said housing, said air flaps being controlled by said regulating means.

3. A burner as claimed in claim 1 further comprising an annular jacket extending from said outlet end of said wall means and about said burner heads.

* * * * *